US010640716B2

(12) United States Patent
Rodwell

(10) Patent No.: US 10,640,716 B2
(45) Date of Patent: May 5, 2020

(54) CONFIGURATIONS AND METHODS OF DEWATERING CRUDE OIL

(71) Applicant: FLUOR TECHNOLOGIES CORPORATION, Aliso Viejo, CA (US)

(72) Inventor: Morgan Charles Rodwell, Calgary (CA)

(73) Assignee: Fluor Technologies Corporation, Sugar Land, TX (US)

( * ) Notice: Subject to any disclaimer, the term of this patent is extended or adjusted under 35 U.S.C. 154(b) by 337 days.

(21) Appl. No.: 14/727,803

(22) Filed: Jun. 1, 2015

(65) Prior Publication Data

US 2015/0344789 A1 Dec. 3, 2015

Related U.S. Application Data

(60) Provisional application No. 62/005,164, filed on May 30, 2014.

(51) Int. Cl.
*C10G 33/00* (2006.01)
*C10G 33/06* (2006.01)
(Continued)

(52) U.S. Cl.
CPC ..... *C10G 33/06* (2013.01); *C10G 7/04* (2013.01); *C10G 33/08* (2013.01)

(58) Field of Classification Search
CPC ..... C10G 33/06; C10G 33/00; C10G 33/08; C10G 31/10
See application file for complete search history.

(56) References Cited

U.S. PATENT DOCUMENTS 3,105,021 A * 9/1963 Randall ..... B01D 3/06 202/160
3,619,416 A 11/1971 Hendry
(Continued)

FOREIGN PATENT DOCUMENTS

CA 1209421 A 8/1986
CA 1295571 C 2/1992
(Continued)

OTHER PUBLICATIONS

PCT Application No. PCT/US2015/033620, International Search Report, dated Aug. 26, 2015, 6 pages.
(Continued)

*Primary Examiner* — Michelle Stein
(74) *Attorney, Agent, or Firm* — Conley Rose, PC

(57) ABSTRACT

A process for dewatering crude oil is described. The process includes feeding crude oil onto a separation of a cyclone separator that is at least partially disposed in a flash vessel. The temperature are pressure in the flash vessel are selected such that at least 20% of the water contained in the crude oil is flashed from the crude oil as it moves on the separation surface of the cyclone separator. The flow rate and angle of the crude oil inlet is selected such that the crude oil moves across the separation surface as a film in a helical pattern, providing a substantial foaming-free manner. The vapor that is flashed from the crude oil exits the flash vessel at a top outlet and the liquid crude oil exits the flash vessel at a bottom outlet.

17 Claims, 6 Drawing Sheets

(51) Int. Cl.
*C10G 7/04* (2006.01)
*C10G 33/08* (2006.01)

(56) References Cited

U.S. PATENT DOCUMENTS

| | | | | | |
|---|---|---|---|---|---|
| 3,644,194 | A | | 2/1972 | Keely | |
| 3,840,468 | A | * | 10/1974 | Rogenhofer et al. .. | B01D 1/225 159/49 |
| 4,160,720 | A | | 7/1979 | Seader et al. | |
| 4,369,047 | A | | 1/1983 | Arscott et al. | |
| 4,428,839 | A | | 1/1984 | Davies et al. | |
| 4,551,198 | A | | 11/1985 | Wiley | |
| 4,584,064 | A | * | 4/1986 | Ciais ..... | C10G 33/06 159/22 |
| 4,883,582 | A | | 11/1989 | McCants | |
| 5,948,242 | A | * | 9/1999 | Ohsol ..... | C10G 33/04 208/179 |
| 6,042,718 | A | | 3/2000 | Bland et al. | |
| 6,372,123 | B1 | | 4/2002 | Kresnyak et al. | |
| 7,736,518 | B2 | | 6/2010 | Smith et al. | |
| 7,931,719 | B2 | | 4/2011 | Sams et al. | |
| 2002/0079248 | A1 | | 6/2002 | Kresnyak | |
| 2005/0172583 | A1 | * | 8/2005 | Wydra ..... | B01D 45/04 55/337 |
| 2013/0264247 | A1 | | 10/2013 | Cardenas et al. | |

FOREIGN PATENT DOCUMENTS

| | | | |
|---|---|---|---|
| CA | 2949975 | A1 | 12/2015 |
| CN | 203355324 | U | 12/2013 |
| EP | 0267187 | B1 | 12/1986 |
| WO | 01/59257 | A1 | 8/2001 |
| WO | 2005/113713 | A2 | 12/2005 |
| WO | 2015184464 | A1 | 12/2015 |

OTHER PUBLICATIONS

PCT Application No. PCT/US2015/033620, Written Opinion of the International Searching Authority, dated Aug. 26, 2015, 8 pages.
PCT Application No. PCT/US2015/033620, International Preliminary Report on Patentability, dated Dec. 15, 2016, 10 pages.
Aker Solutions, "Processing solutions", brochure, downloaded Apr. 28, 2014.
Barletta, T. et al., "Foam control in crude units", Mass Transfer: Distillation, Autumn 2004, pp. 117-125.
Rodwell, Morgan, "Configurations and Methods of Dewatering Crude Oil," filed May 30, 2014, U.S. Appl. No. 62/005,164.

* cited by examiner

CONFIGURATIONS AND METHODS OF DEWATERING CRUDE OIL

This application claims the benefit of priority of U.S. provisional application Ser. No. 62/005164, filed on May 30, 2014.

FIELD OF THE INVENTION

The field of the invention is processing of crude oil, and especially as it relates to water removal from crude oil.

BACKGROUND

The background description includes information that may be useful in understanding the present invention. It is not an admission that any of the information provided herein is prior art or relevant to the presently claimed invention, or that any publication specifically or implicitly referenced is prior art.

Separation of oil and water, and especially separation of water from heavy crudes is often challenging due to the relatively large volume, small differences in oil and water densities, and viscosity of the feed. Some facilities add a light hydrocarbon diluent to facilitate separation oil and water; however, the use of diluent often adds significant cost and increases volumes and equipment size. In another known approach to remove water from the crude, a flash treating process can be implemented in which the crude is heated to a temperature that allows flashing of steam from the crude to so produce dewatered crude and a steam stream as described, for example, in U.S. Pat. No. 6,372,123. Unfortunately, such flashing typically generates substantial quantities of foam that must be sprayed down with a portion of the dewatered crude. Thus, such approach requires one or more recycle pumps to move significant amounts of dewatered liquid for foam suppression and will so add to equipment and operational costs. For example, a typical installation will require 2-3 times the throughput to suppress foam, which forces the separation vessel to be significantly large.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Flashing is also known in preflash drums that flash off light boiling hydrocarbons from a liquid feed to a crude unit. Preflash drums are a known source of foam problems where the light hydrocarbon vapors and the crude liquid tend to readily form bubbles. As a solution, vortex tube clusters can be implemented in the drum to reduce foam formation as is reported in PTQ Autumn 2004 article entitled "Foam Control in Crude Units". While such solution is generally suitable for defoaming a liquid crude feed, it is limited to separating the light boiling hydrocarbons from the liquid feed that are both fed to the crude unit.

Therefore, even though various systems and methods for water removal from crude oil are known in the art, various disadvantages nevertheless remain. Thus, there is still a need to provide improved systems and methods for dewatering crude oil.

SUMMARY OF THE INVENTION

The inventive subject matter provides devices, systems, and methods in which a cyclone separator (most preferably in-vessel or in-tank multi-cyclone separator) is used to treat the flashed crude oil product to so reduce or even prevent foam formation without recycling relatively large volumes of dewatered product, which in turn allows for a substantial reduction in size for the separator. Most preferably, contemplated cyclone separators will be configured and operated such that the cyclone area and the angular velocity of the (flashed/flashing) crude oil will be sufficient to allow for satisfactory water removal and prevention of foam.

From a methods perspective, the inventive subject matter includes a process of water removal from crude oil, comprising: (i) feeding the crude oil at a flow rate and a temperature into a flash vessel that is fluidly coupled to a cyclone separator having a separation surface; and (ii) flashing the crude oil in the flash vessel, wherein the separation surface, a pressure in the flash vessel, the temperature of the crude oil in the separator, and the flow rate are selected such as to allow flashing of at least 50% of water as steam from the crude oil in the flash vessel without foam carry-over into a vapor phase and a liquid phase leaving the flash vessel.

In one aspect of some embodiments, the temperature and pressure in the flash vessel are selected such that at least part of the flashing occurs in the cyclone separator. In addition, the separation surface, the pressure in the flash vessel, the temperature of the crude oil in the separator, and the flow rate are selected such as to allow flashing of at least 70%, and more preferably at least 90%, of water as steam from the crude oil in the flash vessel without foam carry-over into the vapor and liquid phase.

In other aspects of some embodiments, the method could further include the steps of condensing the steam from the vapor phase to form liquid water, some light hydrocarbon liquid, and a hydrocarbon vapor, and then separating the liquid water, the light hydrocarbon liquid, and the hydrocarbon vapor into three streams.

The inventive subject matter also includes a water removal unit for treatment of crude oil. The water removal unit comprises a flash vessel fluidly coupled to a cyclone separator. The unit also includes a control unit operationally coupled to the flash vessel and programmed to regulate the temperature in the flash vessel, the flow rate of the crude oil, and the pressure in the flash vessel such as to allow flashing of the crude oil in the flash vessel. In addition, the cyclone separate has a separation surface. The size and configuration of the separation surface and the control unit are configured such that the pressure in the flash vessel, the temperature of the crude oil in the separator, and the flow rate enable flashing of at least 50% of water as steam from the crude oil in the flash vessel without foam carry-over into a vapor phase and a liquid phase leaving the flash vessel.

In one aspect of some embodiments the cyclone separator is internal to the flash vessel and is a multi-cyclone separator. In yet other aspects, the water removal unit also has a condenser unit coupled to the flash vessel and configured to condense the steam from the vapor phase to thereby produce a hydrocarbon vapor.

The inventive subject matter also includes a method of controlling water removal from crude oil in a flash vessel, comprising the steps of: (i) operationally coupling a control unit to a flash vessel and programming the control unit to regulate at least one of a temperature in the flash vessel, a flow rate of the crude oil, and a pressure in the flash vessel such as to allow flashing of the crude oil in the flash vessel; and (ii) using the control unit to regulate the pressure in the flash vessel, the temperature of the crude oil in the separator, and the flow rate to so enable flashing of at least 50% of water as steam from the crude oil in the flash vessel without foam carry-over into a vapor phase and a liquid phase leaving the flash vessel.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
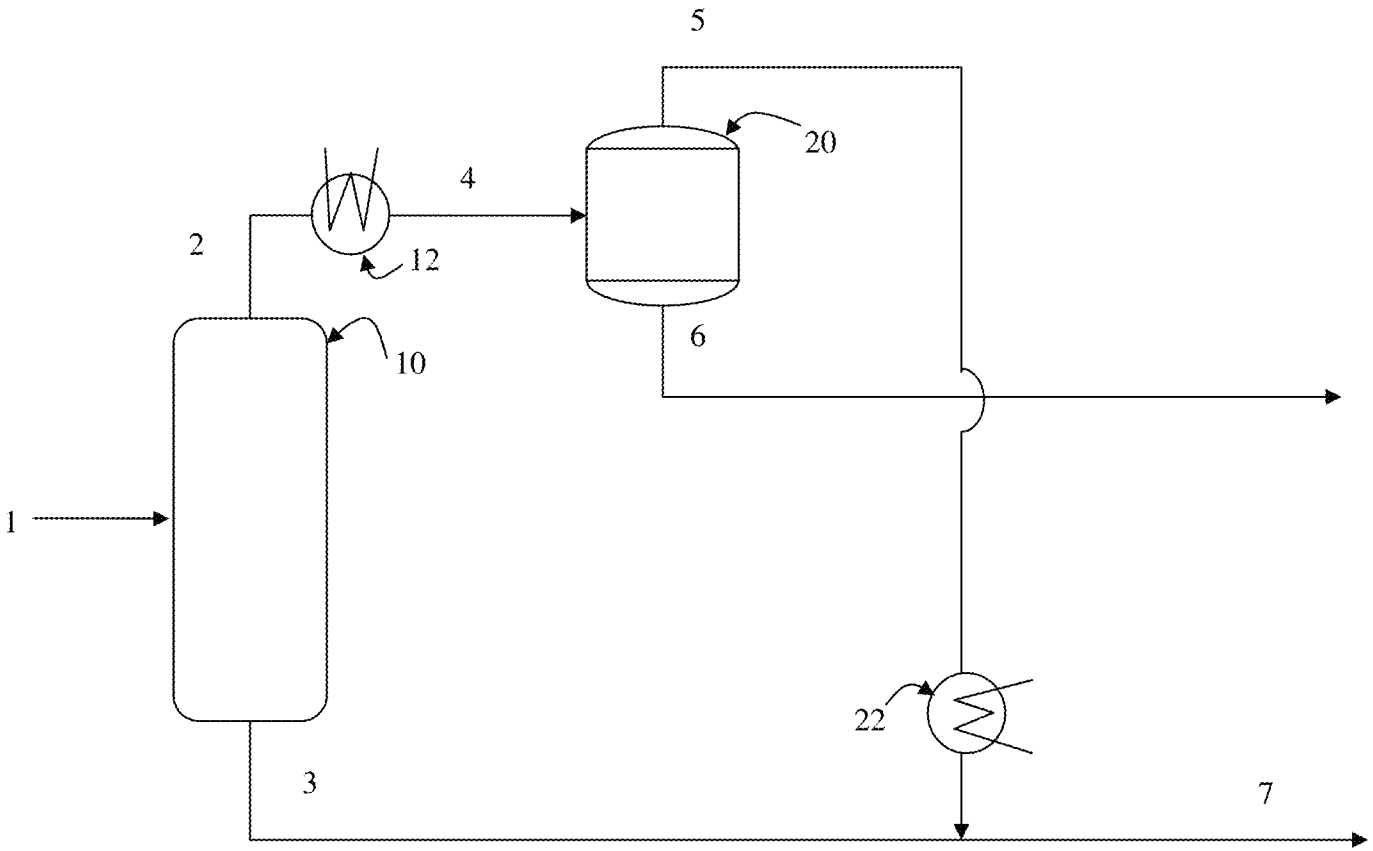
FIG. 1 is an exemplary schematic of a process and system for dewatering crude oil.

FIG. 1 shows a process for dewatering crude oil. Crude oil feed stream 1 enters flash vessel 10 at an inlet. Flash vessel 10 has a temperature and pressure that is selected such that at least 20%-40%, more preferably at least 70%, most preferably at least 90%, of the water in the crude oil is flashed into a steam vapor stream 2 exiting a top inlet of flash vessel 10. The liquid crude oil falls to the bottom of flash vessel and exits a bottom outlet as liquid stream 3. Stream 2 is then fed into condenser 12 and leaves as a cooled stream 4. Condenser 12 is configured to separate water from lighter hydrocarbons by cooling the water until it turns into liquid, while maintaining the lighter hydrocarbons in a vapor phase. Stream 4 is then fed into separator 20 where the lighter hydrocarbons rise to the top and exit a top outlet as stream 5. The liquid water portion of stream 4 falls to the bottom of separator 20 and exits a bottom outlet as liquid water stream 6. Stream 5 is then fed through a condenser 22 and converted into a liquid, which is combined with stream 3, resulting in a stream 7. Stream 7 can then be fed into a crude oil processing unit. Stream 6 can be fed into additional separation units to remove any residual liquid hydrocarbons or can otherwise be disposed of used in further processes.

The inventor has now discovered that foam in the effluent streams from a flash vessel of a crude oil water separation unit (e.g., streams 2 and 3) can be substantially reduced, if not even entirely avoided by use of a cyclone separator that is configured and operated such that foam bubbles that are produced in the process of flashing are collapsed on the surface of the cyclone separator. To that end, the inventor recognized that various process parameters should be implemented to enable such foam reduction or avoidance.

Figure 2:
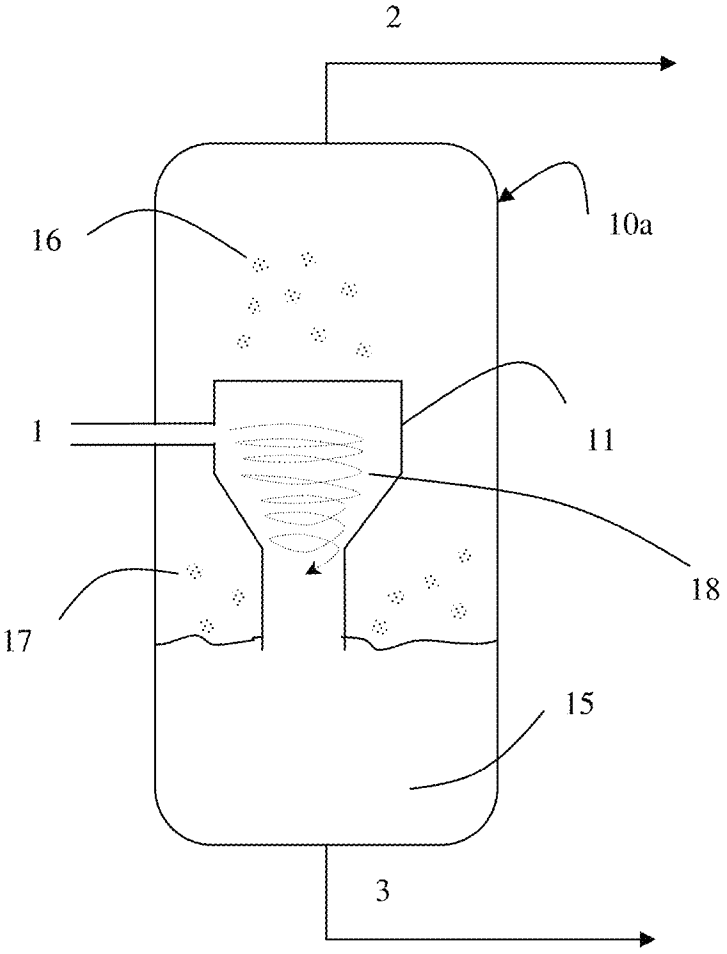
FIG. 2 is a flash vessel that has a single stage cyclone separator.

FIG. 2 shows a schematic of one embodiment of a flash vessel having a cyclone separator at least partially disposed therein. Inside the lumen of flash vessel 10*a* is a cyclone separator 11. Separator 11 has an open top from which flashed steam 16 escapes and rises upward. Separator 11 has a conical shape with a cross-sectional diameter that gradually decreases as the crude oil follows through it. A crude oil feed stream 1 is introduced onto an interior surface of cyclone separator 11 (i.e., the "separation surface") via an inlet at the top of cyclone separator 11. The flow rate of the crude oil at the inlet, and the angle of the inlet relative to the separation surface, is selected such that the crude oil flows across the separation surface as a thin film in a helical pattern 18. Creating a thin film of crude oil across the separation surface allows the water to more readily flash from the crude oil. In addition, the film prevents and/or reduces foaming. The film of crude oil flows to the bottom of flash vessel 10*a* and collects in a pool of dewatered (or partially dewatered) liquid crude oil 15. Water may continue to flash from pool 15 and rise to the top outlet of flash vessel 10*a*, exiting as stream 2. The dewatered liquid crude oil exits flash vessel 10*a* as stream 3.

Specifically, it should be appreciated that to reduce or avoid foam in the effluent streams, the surface area of the cyclone separator and liquid film thickness (and with that the flow rate through the flash vessel/cyclone separator) should be matched to the temperature and pressure gradient in the flash vessel. Using appropriate process controls as described in more detail below, the operation of a dewatering unit can be substantially simplified and flash vessel volume can be reduced. Viewed from a different perspective, it should be appreciated that upon selection of the appropriate temperature and flow volume a suitable viscosity and film thickness can be achieved that allows for effective flashing while promoting centrifugal force-driven foam collapse. Of course, such parameters will also be affected by the pressure drop during flashing. Thus, it should be recognized that the configurations and methods presented herein are especially advantageous as they obviate recycle pumps and diluents and use cyclone-type internal devices to suppress foam, allowing the separator to be smaller.

Considering the above, the inventor therefore contemplates a method of water removal from crude oil that includes a step of feeding crude oil at a flow rate and a temperature into a flash vessel that is fluidly coupled to a cyclone separator having a separation surface and a step of flashing the crude oil in the flash vessel. In such methods, it should be appreciated that the separation surface, the pressure in the flash vessel, the temperature of the crude oil in the separator, and the flow rate are selected such as to allow flashing of at least 50%, more typically at least 70%, and most typically at least 90% of water as steam from the crude oil in the flash vessel and/or cyclone separator without foam carry-over into the vapor and liquid phases leaving the flash vessel. Most typically, the cyclone separator is internal to the flash vessel, and in at least some aspects of the inventive subject matter, the cyclone separator is an in-tank multi-cyclone separator. Furthermore, it should be noted that while not limiting to the inventive subject matter, conditions in the flash vessel may be selected such that at least part of the flashing occurs in the cyclone separator. Furthermore, it is generally contemplated that the steam from the vapor phase may be condensed and removed to so form a hydrocarbon vapor (which may be fed together with the liquid phase into a crude unit.

Figure 3:
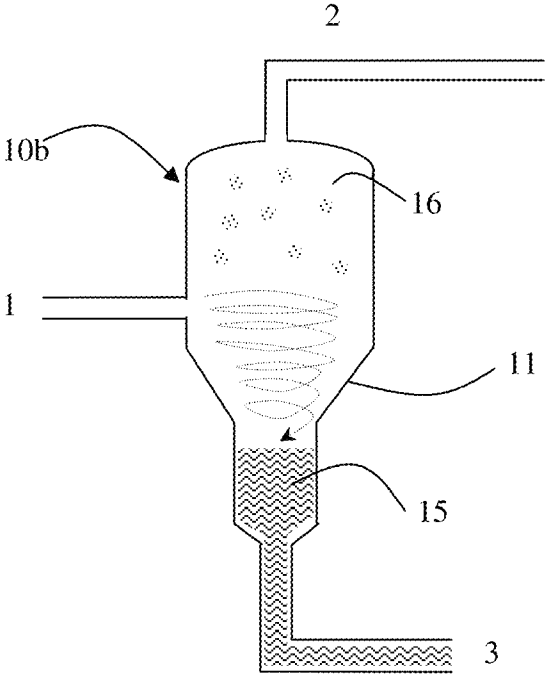
FIG. 3 is a flash vessel that is integral with a cyclone separator.

FIG. 3 shows another embodiment of a flash vessel that has a cyclone separator. Flash vessel 11*b* is functionally similar to flash vessel 11*a* in many regards. However, a portion of the exterior wall of flash vessel 10*b* forms the cyclone separator 11. Crude oil feed stream 1 enters flash vessel 10*b* and immediately onto the separator surface of cyclone separator 11. The crude oil then flows across the separation surface in a helical pattern 11 and collects in a pool 15 at the bottom of flash vessel 10*b*. Water (and possibly lighter hydrocarbons) is flashed from the crude oil as it moves across the separation surface and rises to the top of flash vessel 10*b* as steam 16. Steam 16 exits flash vessel 10*b* as stream 2.

Figure 4:
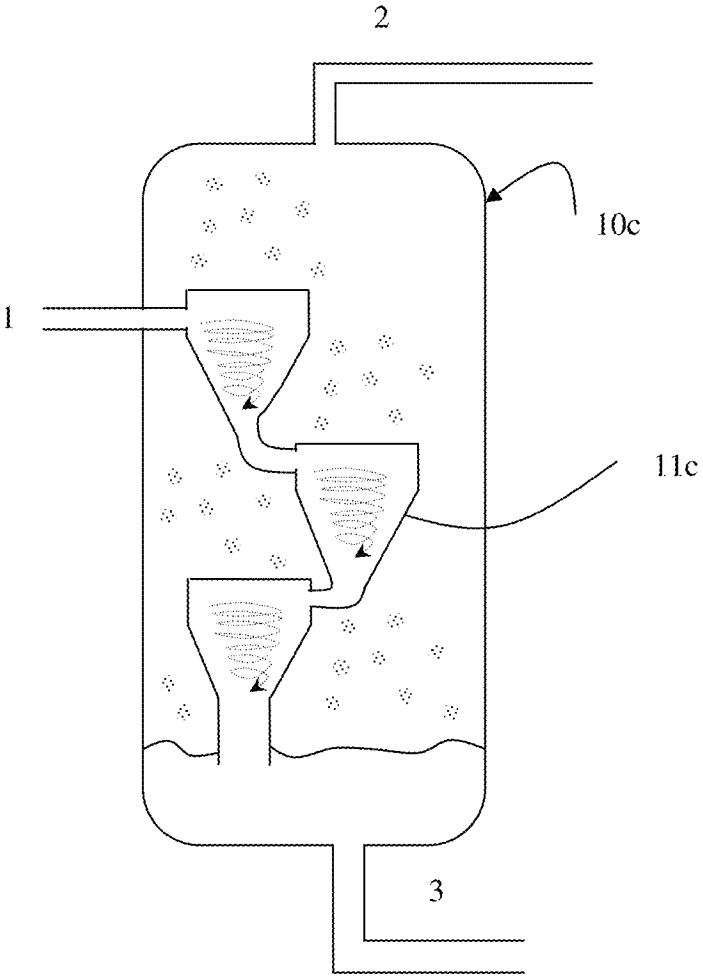
FIG. 4 is a flash vessel that has a multi-stage cyclone separator.

FIG. 4 shows yet another embodiment of a flash vessel that has a cyclone separator. Flash vessel 10*c* is functionally similar to flash vessel 10*a* and 10*b* in many regards. However, flash vessel 10*c* has a multi-stage cyclone separator 11*c*. Separator 11*c* comprises three individual cyclone separators fluidly coupled together. Each stage has an open top that allows flashed steam to rise upward and exit the top of flash vessel 10*c* as stream 2. The flow rate and inlet angle for each stage is configured and regulated such that the crude oil is fed into each cyclone separator as a thin film flowing in a helical pattern. The liquid crude oil eventually exits the multi-stage cyclone separator 11*c* at the bottom of flash vessel 10*c* and exits the bottom outlet as stream 3.

Figure 5:
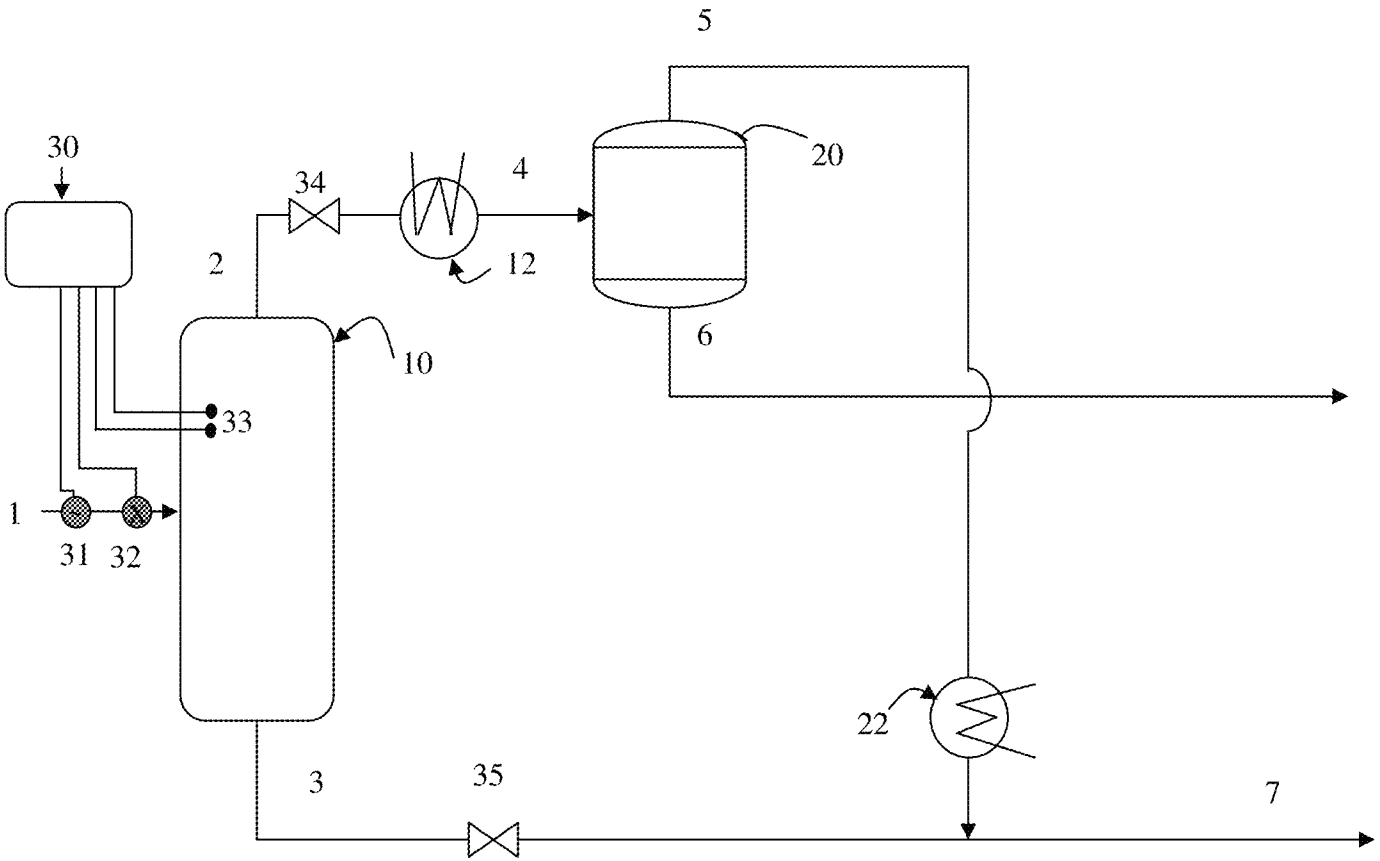
FIG. 5 is an exemplary schematic of a process and system for controlling operating parameters of a flash vessel.
Figure 6:
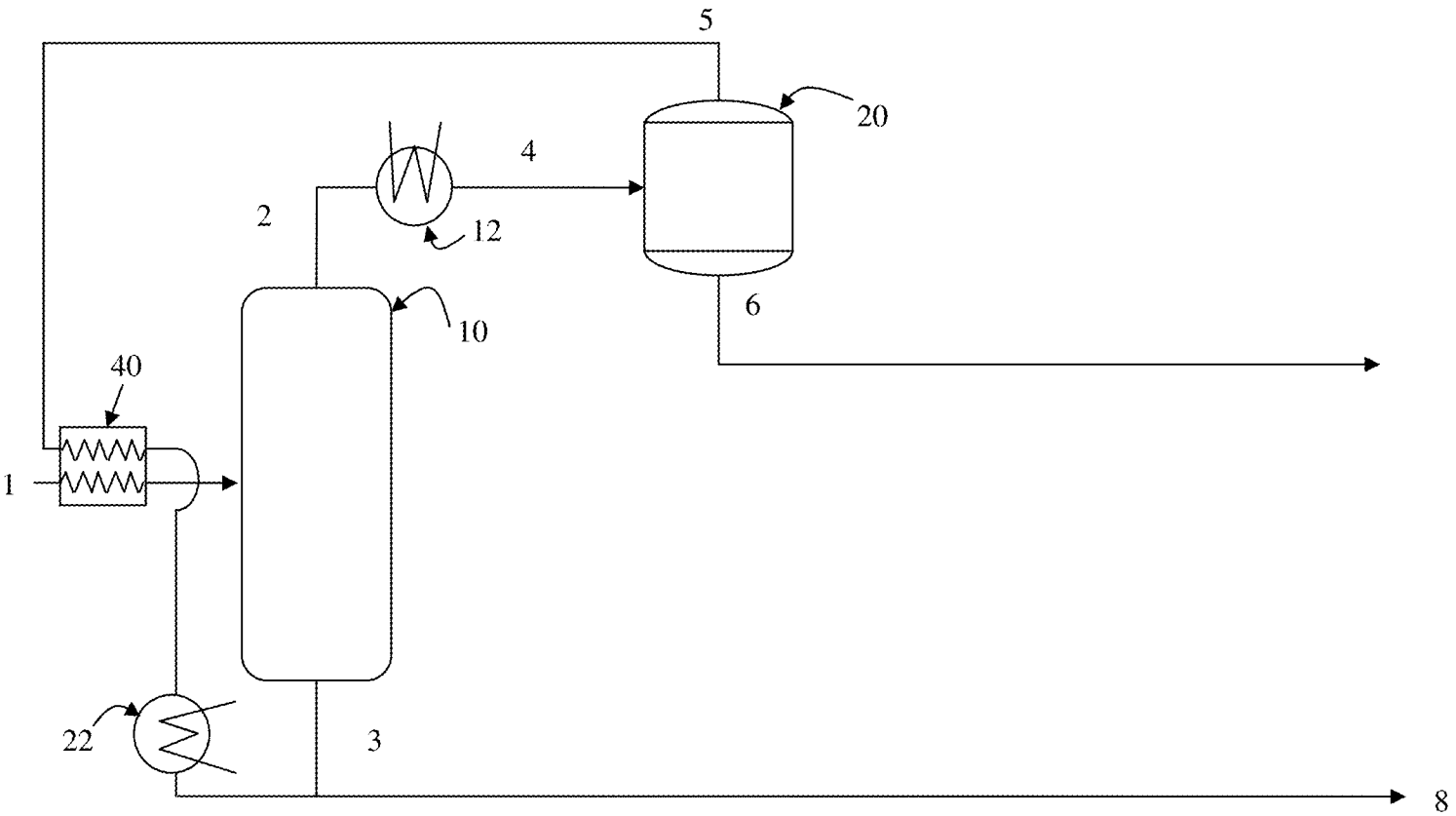
FIG. 6 is another exemplary schematic of a process and system for dewatering crude oil.

FIG. 5 shows a schematic of another process of dewatering crude oil. The process is similar to the process of FIG. 1 and identical reference numerals are used to denote identical components. FIG. 5 additionally has a control unit 30. Control unit 30 has one or more sensors 33 located inside the lumen of flash vessel 10 for monitoring the temperature, pressure, flow rate, and other process parameters of flash vessel 10. Control unit 30 could also include sensors for monitoring upstream (e.g., stream 1) and downstream (e.g., stream 2 and 3) of flash vessel 10. Control unit analyzes sensory data and uses the information to regulate the conditions of stream 1 via flow rate regulator 32, temperature regulator 31, and pressure regulators 34, 35. Control unit 30 is programmed to regulate operational parameters of flash vessel 10 such that at least 20% of the water contained in the crude oil is flashed from the crude oil as steam while the crude oil is moving on the separation surface of the cyclone separator in flash vessel 10. More preferably, the control unit is programmed to flash at least 40%, more preferably at least 70%, most at least 90% of the water from the crude oil as the crude oil moves across the separation surface. In addition, the control unit is programmed to regulate pressure, temperature, and the flow rate such as to allow flashing of the water as steam from the crude oil without foam carry-over into a vapor phase leaving the flash vessel. More preferably, the control unit is programmed to regulate operational parameters such that flashing is performed under a condition that allows substantially foaming-free flashing.

The control unit can also be programmed to achieve a specific pressure gradient in the flash vessel. For example, the control unit can be programmed to maintain a pressure drop of at least 10 psig, at least 20 psig, at least 50 psig, etc.

Those of ordinary skill in the art will appreciate that the composition and attributes of the crude oil (e.g., temperature, pressure, viscosity, % of crude oil) will affect the operational parameters that are needed to achieve the desired objectives of the present inventive subject matter.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Viewed from a yet another perspective, the inventor also contemplates a method of controlling water removal from crude oil in a flash vessel where in one step a control unit is operationally coupled to a flash vessel and programmed to regulate temperature in the flash vessel, the flow rate of the crude oil, and/or the pressure in the flash vessel such as to allow flashing of the crude oil in the flash vessel. In such methods, the control unit is then used to regulate the pressure/temperature in the flash vessel, and/or the flow rate to so enable flashing of at least 50%, more typically at least 70%, and most typically at least 90% of water as steam from the crude oil in the flash vessel without foam carry-over into a vapor phase and a liquid phase leaving the flash vessel.

Consequently, the inventor also contemplates a water removal unit for treatment of crude oil that includes a flash vessel that is fluidly coupled to a cyclone separator. A control unit is operationally coupled to the flash vessel and programmed to regulate the temperature in the flash vessel, the flow rate of the crude oil, and/or the pressure in the flash vessel such as to allow flashing of the crude oil in the flash vessel. Most typically, the separation surface of the cyclone separator is selected such and the control unit is programmed such that the pressure in the flash vessel, the temperature of the crude oil in the separator, and the flow rate enable flashing of at least 50% of water as steam from the crude oil in the flash vessel without foam carry-over into a vapor phase and a liquid phase leaving the flash vessel. As before, it is generally preferred that the cyclone separator is internal to the flash vessel, and most typically configured as an in-tank multi-cyclone separator. While not limiting to the inventive subject matter, a condenser unit is coupled to the flash vessel to condense the steam from the vapor phase to thereby produce a hydrocarbon vapor that can then be fed (together with the liquid phase) to a crude unit.

With respect to the crude oil it is generally preferred that the crude oil is a heavy crude oil from which sand has been at least partially removed. However, it should be noted that the crude oil may also be light or sweet crude, which may or may not be pre-processed. Regardless of the particular composition, it should be appreciated that crude oil has a substantial viscosity (e.g., between 10-30 cP), and likely for at least that reason, cyclone separation has not been deemed suitable, particularly where relatively large volumes of crude are being processed. Nevertheless, where the crude has an elevated temperature, and/or the flow rate and cyclone separator surface are properly dimensioned to allow for an appropriate balance of flashing surface and surface for centripetal bubble suppression, it should be recognized that foam formation in the separator vessel can be reduced or even entirely avoided.

Thus, numerous flash vessels are also deemed suitable, and especially preferred flash vessels are configured such that they will withstand feed pressure of the crude oil and allow for appropriate flashing (including vacuum flashing). It is still further preferred that the flash vessel is also suitable to host an internal cyclone separator. With respect to the volume, it is generally contemplated that all volumes are appropriate that allow for holding and flashing the crude oil at the desired feed rate. Most typically, the flash vessel will exhibit additional (e.g., at least 20%) capacity to so act as surge drum where feed rates change. However, it should be noted that the volume will in most cases be substantially smaller than for flash units that use spray-down or diluent when processing same volumes of crude.

Likewise, it should be noted that the nature of the cyclone separator may vary considerably, and that suitable cyclone separators will include single cyclone and multiple cyclone units. However, suitable cyclone separator units should have a minimum separation surface that allows for film formation such that bubbles/foam present on the liquid phase on the film has sufficient time to be collapsed by the centripetal force. Thus, the surface must be angled appropriately and operated at a sufficient flow rate.

Consequently, and with respect to the operation of devices and systems presented herein, the inventors contemplate that the flow rate, cyclone separator area, pressure drop for flashing, and temperature require proper balancing to achieve a desired design rate of water removal while avoiding foam formation. In one contemplated example, a heavy crude oil with a gravity of between 5 and 19° API containing 1-20% water is heated to a temperature of between 150 and 250° C. at a pressure high enough to maintain the oil and water in a liquid phase. The crude oil is then letdown to a lower pressure through a control valve such that the water is primarily (typically >50%, more typically >70%, and most typically >90%) in the vapor phase as steam. Some light hydrocarbon material may also vaporize at these conditions. The selection of the specific temperature and pressure depends on the oil composition and water content, but the typical pressure range of the low pressure flash is between atmospheric pressure and 700 kPaA. The material would pass into the cyclone or multi-cyclone device where the mixture's inertia would be converted to angular momentum. The mixture would distribute into a film on the walls of the cyclone, collapsing any foam bubbles and improving disengagement of the vapor phase from the liquid crude oil product. The dehydrated crude oil product would flow from the bottom of the cyclone and collect in the bottom of the vessel/tank, from which it could flow or be pumped to a final destination. The vapor would exit the top of the cyclone and flow out of the top of the flash vessel/tank. This vapor would then flow through a condenser where heat is extracted (to a cooling medium such as air, cooling water of other liquid medium or refrigerant) and the vapors are mostly converted back to liquid water and light hydrocarbons. Some light hydrocarbon vapors or other non-condensable components may remain and must be handled in a vapor recovery system or used as fuel gas.

It should be apparent to those skilled in the art that many more modifications besides those already described are possible without departing from the inventive concepts herein. For example, contemplated systems and methods could be implemented in other oil/water separation problems, notably in handling slop oil or rag material from oil processing facilities, desalter in refineries, or even on offshore platforms.

The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of water removal from crude oil and water mixture, comprising:

feeding the crude oil and water mixture at a flow rate and a temperature onto an interior separation surface of a cyclone separator as a thin film, wherein the crude oil and water mixture are fed to an inlet at a top of the cyclone separator, wherein the cyclone separator is at least partially disposed within a flash vessel;

flashing at least 20% of the water contained in the crude oil as steam from the crude oil while the crude oil and water mixture is moving on the separation surface in a helical pattern as a thin film;

collapsing foam bubbles on the separation surface of the cyclone separator; and wherein the separation surface, a pressure in the flash vessel, the temperature of the crude oil in the cyclone separator, and the flow rate are selected such as to allow flashing of the water as steam from the crude oil without foam carry-over into a vapor phase leaving the flash vessel.

2. The method of claim 1, wherein the flash vessel has a crude oil inlet for feeding the crude oil onto the separation surface; wherein the separation surface of the cyclone separator is not rotatable; wherein a flow of the crude oil and water mixture is downward; and wherein an area of the separation surface of the cyclone separator and an angular velocity of the crude oil and water mixture are configured to allow for water removal and prevention of foam.

3. The method of claim 2, wherein the flash vessel has a liquid outlet that is located below the crude oil inlet.

4. The method of claim 2, wherein the flash vessel has a vapor outlet that is located above the crude oil inlet.

5. The method of claim 1, wherein the cyclone separator is suspended within the flash vessel by the inlet.

6. The method of claim 5, wherein the separation surface, the pressure in the flash vessel, the temperature of the crude oil in the cyclone separator, and the flow rate are selected such as to allow flashing of at least 70% of water as steam from the crude oil in the flash vessel.

7. The method of claim 1 wherein the separation surface, the pressure in the flash vessel, the temperature of the crude oil in the cyclone separator, and the flow rate are selected such as to allow flashing of at least 90% of water as steam from the crude oil in the flash vessel.

8. The method of claim 1, further comprising the steps of:

condensing the vapor phase leaving the flash vessel to form liquid water, some light hydrocarbon liquid, and a hydrocarbon vapor; and separating the liquid water, the light hydrocarbon liquid, and the hydrocarbon vapor.

9. The method of claim 1, further comprising:

operationally coupling a control unit to a flash vessel and programming the control unit to regulate at least one of a temperature of the crude oil in the flash vessel, a pressure in the flash vessel, and a flow rate of the crude oil such as to allow flashing of the crude oil in the flash vessel, wherein feeding the crude oil at the flow rate and the temperature onto the separation surface of the cyclone separator comprises:

using the control unit to regulate the pressure in the flash vessel, the temperature of the crude oil in the flash vessel, and the flow rate to so enable flashing of at least 50% of water as steam from the crude oil in the flash vessel without foam carry-over into a vapor phase and a liquid phase leaving the flash vessel.

10. The method of claim 9, wherein the flash vessel comprises a multi-cyclone separator at least partially disposed in a lumen of the flash vessel.

11. The method of claim 1, wherein feeding the crude oil at the flow rate and the temperature onto the separation surface of the cyclone separator comprises:

moving the crude oil on the separation surface across a pressure gradient and at a velocity and angle that are sufficient to suppress foam formation; and wherein the temperature of the crude oil is sufficient to allow flashing of the steam at the pressure gradient.

12. The method of claim 11, wherein the pressure gradient is a pressure drop of at least 10 psig.

13. The method of claim 11, further comprising the step of adjusting at least one of the temperature and the pressure gradient to allow flashing.

14. The method of claim 11, wherein the angle is sufficient for cyclone separation.

15. The method of claim 11, wherein the film has a thickness of between 1 mm and 20 mm.

16. The method of claim 11, wherein the separation surface is part of a cyclone separator.

17. The method of claim 1, wherein the crude oil and water mixture is free from diluents.

* * * * *